US005146055A

United States Patent [19]

Boucheron et al.

[11] Patent Number: 5,146,055

[45] Date of Patent: Sep. 8, 1992

[54] CURRENT LIMITING SWITCH DEVICE

[75] Inventors: Thierry Boucheron, Maurecourt; Blanchard Christian, Rueil Malmaison; Michel Lauraire, Courbevoie, all of France

[73] Assignee: Telemecanique, France

[21] Appl. No.: 584,824

[22] Filed: Sep. 19, 1990

[30] Foreign Application Priority Data

Sep. 20, 1989 [FR] France ..... 89 12391

[51] Int. Cl.[5] ..... H01H 9/36; H01H 33/10

[52] U.S. Cl. ..... 200/144 R; 200/147 R

[58] Field of Search ..... 200/144 R, 147 R, 147 A, 200/147 B, 144 C; 335/201

[56] References Cited

U.S. PATENT DOCUMENTS

| | | | |
|---|---|---|---|
| 2,555,799 | 6/1951 | Lerstrup | 200/147 R |
| 3,483,343 | 12/1969 | Heft | 200/147 R |
| 3,564,176 | 2/1971 | Fechant | 200/144 R |
| 4,082,931 | 4/1978 | Hayes | 200/144 C |
| 4,112,275 | 9/1978 | Kohler | 200/147 R |
| 4,387,281 | 6/1983 | Haury et al. | 200/147 R |
| 4,491,705 | 1/1985 | Hayashi et al. | 200/147 R |
| 4,516,005 | 5/1985 | Gallatin et al. | 200/147 R |
| 4,652,707 | 3/1987 | Mori et al. | 200/144 R |

*Primary Examiner*—J. R. Scott

*Attorney, Agent, or Firm*—William A. Drucker

[57] ABSTRACT

A finless current limiting switch apparatus is disclosed, in which the cut-off chamber, containing a fixed contact and mobile contact, has opposite converging walls which lead to a narrow slit where the arc is subjected to narrowing of its section after natural or assisted development thereof along a conducting deflection piece which is connected to the fixed contact and has an end located in the slit or in the vicinity of the slit. The conducting deflecting piece defines a conductive path of movement for the arc.

6 Claims, 4 Drawing Sheets

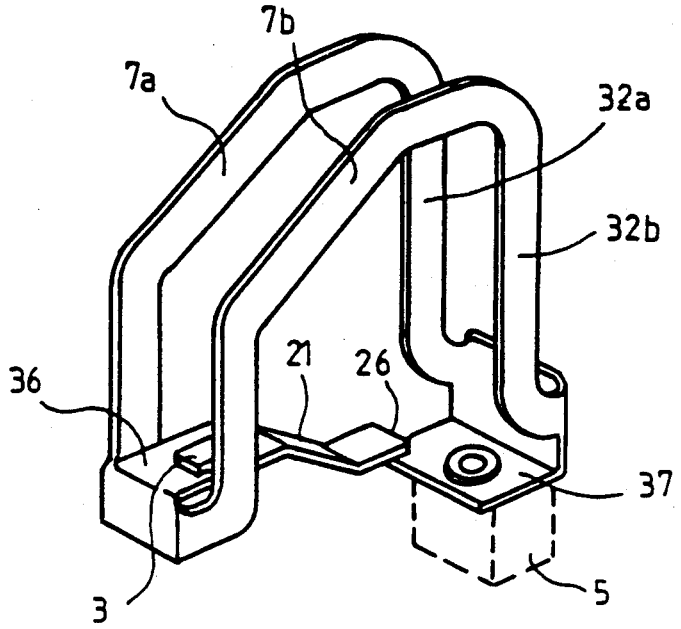
FIG. 3
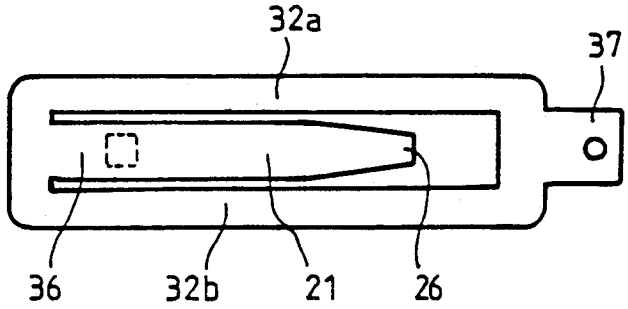
FIG. 4
FIG. 5
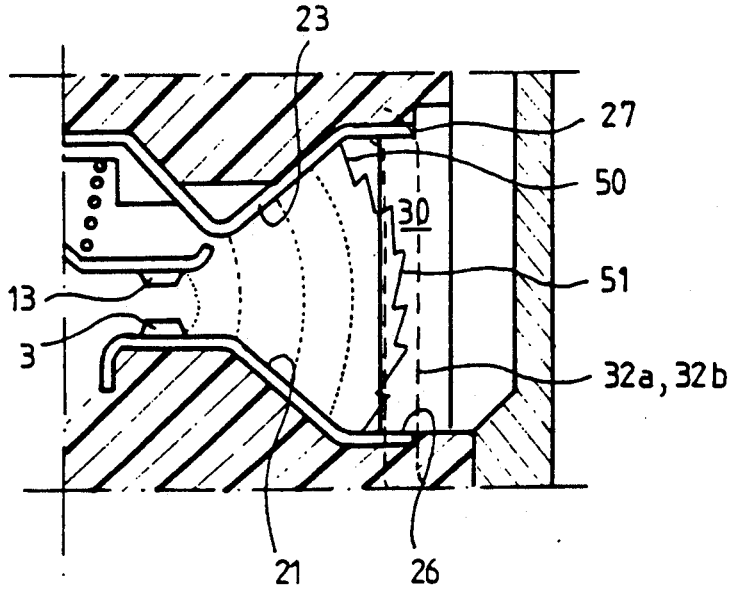

Voltage :100V/div
current :1000 A/div
scanning :1ms/div

CURRENT LIMITING SWITCH DEVICE

BACKGROUND OF THE INVENTION

The invention relates to a current limiting switch device comprising a chamber and a conducting deflector housed in an insulating case. The chamber is connected to the outside and houses a fixed piece and a switching piece movable in a plane. These pieces are equipped with contact studs and a control member acting on the mobile piece is moved for making and breaking an electric circuit. The conducting deflector is connected electrically to the fixed piece and extends into the chamber so that one of the feet of the arc appearing on opening may move in the chamber.

Devices corresponding to the above construction are used particularly in apparatus such as circuit-breakers used for protecting industrial or domestic installation lines.

They may, if required, be used in more complex apparatus where remote controlled current making and breaking means are combined, such as contactors.

Protective apparatus of the circuit breaker type require breaking of the current as rapidly as possible when it undergoes an increase corresponding to that which full short-circuit currents would take. Such apparatus should provide not only very considerable limitation of the intensity of the short-circuit currents but also to make the time interval as short as possible during which these currents will flow in the circuit to be protected.

Since the rate of growth of fault currents is controlled by the voltage developed in the arc which appears between the contacts at the time of opening, this voltage must reach levels as high as possible, considering the supply voltage of the mains.

Prior art methods for increasing the voltage of the arc include adjusting its length, its temperature and its section. For increasing the arc length one communicates to the contacts as wide a spacing as possible in an extremely short time, which requires the use of a comparatively large energy.

It is also known to provide the cut-off chambers in which the switches are disposed, with a multiplicity of metal fins or good heat-conducting fins, so that an arc which is formed thereon is subjected to considerable cooling. An embodiment of this technique, which is still widely used, requires the manufacture, assembly and mounting of fins whose technical cost is relatively high, all the more so since the apparatus is of small size. Moreover, the volume required for positioning such fins requires that there is relative freedom in the choice of dimensions, a situation which occurs less and less frequently, particularly when dimensional standards govern the size of such apparatus.

For increasing the arc voltage, one has priorly used the interaction of a magnetic field with the current so as to promote the natural development of the arc or an insulating screen for extending its arc and/or greatly reducing the section of the arc by choking it against an insulating wall.

SUMMARY OF THE INVENTION

It is an object of the invention to provide a finless current limiting device whose size and technical cost are lower than those of finned switch devices having substantially equivalent limiting characteristics. It is a further object to provide a limiting device comprising, a chamber connected to the outside and housing a fixed piece and a switching piece movable in a plane, these pieces being equipped with contact studs for making and breaking an electric circuit passing through two terminals when a control member acting on the mobile piece is moved;

a deflector which is connected electrically to the fixed piece and which extends into the chamber so that one of the feet of the arc appearing on opening of the electric circuit may move in the chamber, the chamber having two opposite walls converging towards an elongate narrow slit which communicates with the outside and is placed substantially in the plane of movement of the movable piece so that a considerable portion of the length of the arc is driven in the slit during its development.

According to a feature of the invention this device is characterized in that:

the deflector forms a conducting path for the rapid movement of the arc and has an end situated in the vicinity of one end of the slit or in the slit, the width of the chamber and the dimensions of the slit cause narrowing of the section of the arc, a conductor forming a loop placed outside the case is connected to the fixed contact piece and passes in front of the slit.

BRIEF DESCRIPTION OF THE DRAWINGS

FIG. 3 is a perspective view of a double spark extinction loop which may be associated with the switch device of FIG. 1;

FIG. 4 is a top view of a stamped piece from which the spark extinction piece may be obtained by deformation;

FIG. 5 is a view in partial elevation and in section through plane TT', of a switch portion showing the development undergone by the arc during opening;

DESCRIPTION OF THE PREFERRED EMBODIMENTS

Figure 1:
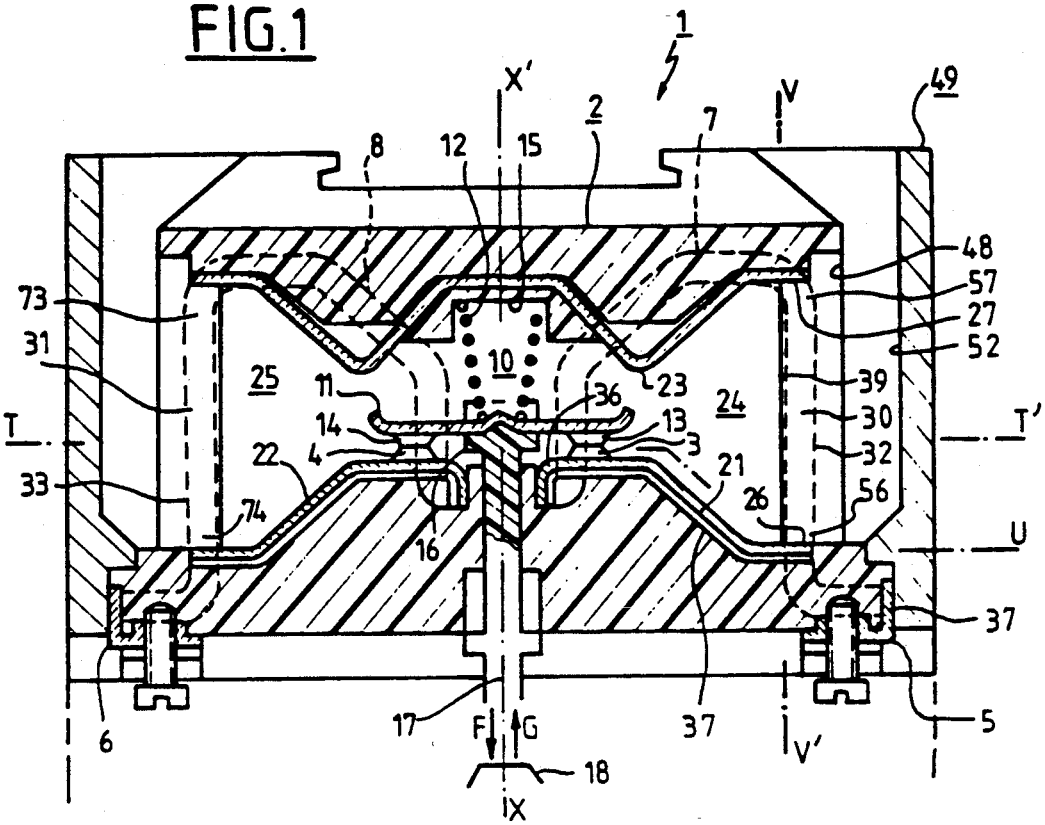
FIG. 1 is an elevational view in section through a mean longitudinal plane TT' of a double cut-off switch device.

A switch device 1, housed in an insulating case 2, shown in FIG. 1, comprises in a plane of symmetry PP' of a cavity 10, which is that of the figure, a pair of fixed contact studs 3, 4 which are connected respectively to two terminals 5, 6 by conductors 7, 8 which carry them and a pair of mobile contact studs 13, 14 carried by a conducting contact bridge 11.

In the non limitative embodiment shown in FIG. 1, a return spring 12 bears on a wall 15 of the chamber and communicates to the contact bridge 11 a measured force so as to apply the mobile contact studs of the switch against the fixed contact studs in the closed state of the switch.

An insulating movable pusher 16, which is advantageously guided in the case and which participates in holding the contact bridge transversely in position, allows a movement in the plane of the figure to be communicated thereto when an end portion 17 of said pusher, accessible from the outside, undergoes movements in direction F or G communicated by a pusher 18. The latter forms the terminal control member of an electric apparatus such as a contact breaker or a contactor protected against overload currents.

In order to facilitate the development and movement of arcs appearing between the contact studs during opening on a short-circuit, two metal pieces 21, 22 connected to the fixed contact studs are disposed in the chamber symmetrically with respect to the axis XX' of movement of the mobile bridge. A third piece 23 not connected electrically and extending symmetrically from a chamber 24 to a symmetrical chamber 25 extends substantially opposite the two pieces 21, 22 while passing under the return spring 12. These metal pieces, also called deflectors, are generally made from steel or copper and serve as conducting path for the upper and lower feet of the arcs which they cool at the same time.

Figure 2:
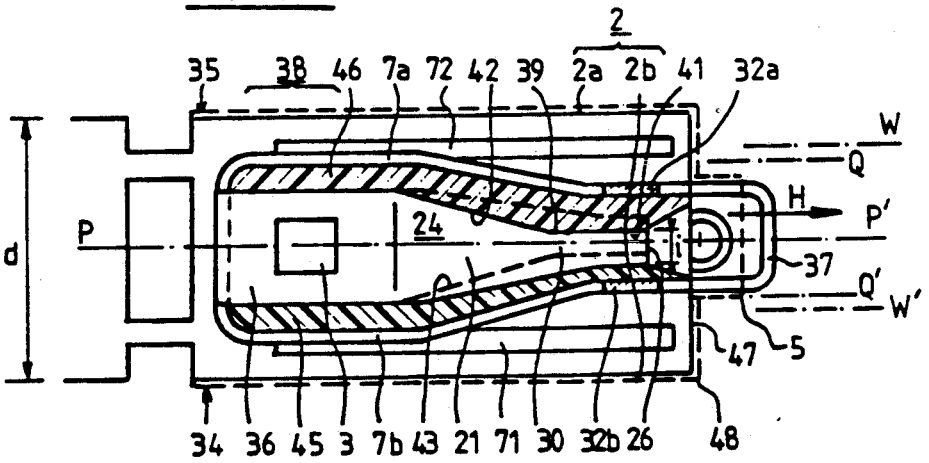
FIG. 2 is a sectional and top view of the device of FIG. 1 through a broken plane TU.

As can be seen in FIG. 1, free ends 26, 27 of these deflectors take divergent paths which lead them into or in the immediate vicinity of an opening in the form of a narrow slit 30, 31 which communicates with the outside, see also FIG. 2.

The conductors 7 or 8, which extend outside the chambers follow loop paths, shown with broken lines in FIG. 1, which bring each of them substantially opposite one of the narrow slits by their rectilinear descending portions 32, 33 parallel to the longitudinal directions thereof.

In a preferred embodiment, see FIGS. 3 and 2, two loops $7_a$, $7_b$ of the same shape are associated with a pair of contact studs such as 3, 13 and extend respectively over two opposite external faces 34, 35 of case 2 and connect together the portions 36, 37, which support a fixed contact stud and the associated terminal 5, 6, see FIG. 2. Deflector 21 is integrally formed with portion 36 so that the loop portions 26, 21, 36, $7_a$, $7_b$, $32_a$, $32_b$, 37 may be manufactured by stamping and bending from the same copper sheet.

In order to improve the efficiency of such loops which in a way known per se develop a magnetic field inside the chamber so as to communicate electromagnetic forces to the arc, promoting its natural swelling, a magnetizable stamped piece 37 of small thickness and having the same profile may be advantageously disposed under a deflector 21.

As is best seen in FIG. 2, the width of chamber 24 decreases from the region 38 where the contact studs are located as far as the entrance 39 of slit 30 which may be extended by a passage 41, by means of two converging walls 42, 43. As mentioned above, this slit and this passage open to the outside in direction H so that gases, whose pressure rises in the chamber on the appearance of the arc, may be discharged therethrough.

The presence of this slit is further intended to cause narrowing, over a considerable length, of the section of the arc which is driven therein. In fact, see FIG. 5, when, on opening of the circuit an arc 50 which originated between the contact studs develops rapidly because of the magnetic assistance provided by the presence of the loops through which the current flows, its feet move rapidly along the deflectors away from the fixed and mobile contact studs, and its length increases substantially because of the divergence thereof. It will be noted that the two arcs which appear simultaneously in chambers 24, 25 are electrically in series because of the flow of their currents through the upper common deflector 23 which itself extends between opposite slit ends 73, 74.

The assisted swelling of arc 50, see FIG. 5, consequently leads practically the whole of its portion 51 into the slit because the dynamic effects of the loop or loops are felt as far as the region close to their portions $32_a$, $32_b$.

Since the dimensions of the slit are chosen to be less than the diameter which the arc column would otherwise assume, this column is forced to undergo a narrowing of section which results in increasing the arc voltage and so considerably reducing the rate of growth of the short-circuit currents.

Although in practice one could use a case 2 having locally an integrally molded slit, the slit will advantageously be formed by the gap —i— separating locally substantially parallel dividing walls 45, 46 of two half cases $2_a$, $2_b$ in the vicinity of a side 47 distant from axis XX' (see FIG. 2). Case 2 will advantageously have the form of a self contained parallelepipedic solid which can be housed in a compartment 48 of an apparatus 49 where fixing means will give it a well defined position with respect to a control pusher 18 and vents 52 opposite slit 30, 41.

Since the rate of growth of short-circuit currents depends on the difference between the voltage of the mains and that which appears at the ends of the arc, optimum matching of the latter with respect to the former may be desired. Such a facility is offered quite readily in the disclosed switch device by adjusting the length and/or width of the slit.

The possibility of choice of a particular width of the slit may be readily obtained, either at the time of manufacture of half cases each having a half slit with different local dimensions, or else by providing half cases equipped with adjustable spacing means.

These means will be advantageously disposed in the vicinity of the slit so as to develop transverse forces able to communicate relative resilient deformations to the half cases.

These means will be further capable of preventing untimely separation of the half cases under the effect of the pressures developed at the time of appearance of an arc so that this slit keeps the width which was assigned to it.

Figure 6:
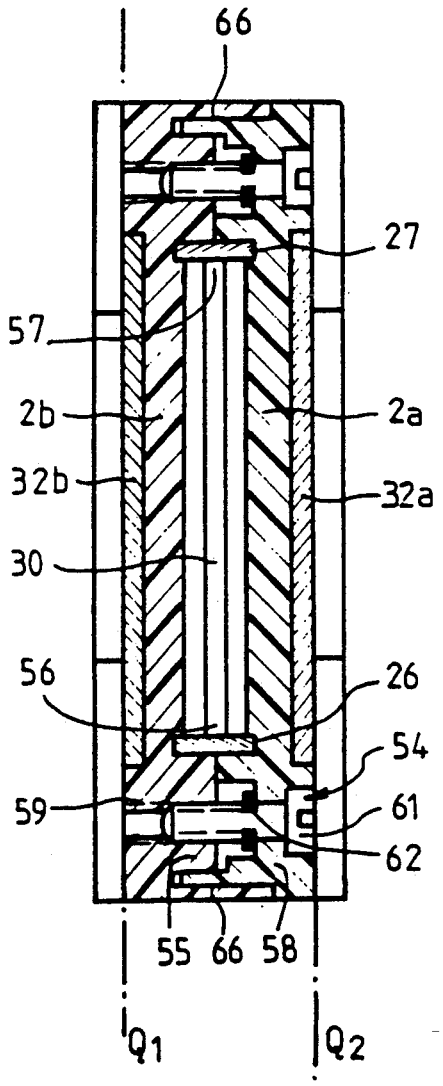
FIG. 6 is a side view in section of the device of FIG. 1 through a plane VV', which further shows an embodiment allowing choice of the voltage.

By way of illustration, an embodiment of such means is shown in FIG. 6. Two screws 54 are disposed in the vicinity of the ends 56, 57 of the slit 30 for communicating resilient separation to the opposite walls 55, 58. The screws are axially fixed to the walls, by means of the threaded portion 59 of the head 61 of the screw and of an axial stop washer 62.

So that the case maintains sealing in the peripheral regions where the half cases are joined, they will be advantageously equipped with parallel walls cooperating so as to form baffles 66, see FIG. 6.

Figure 7:
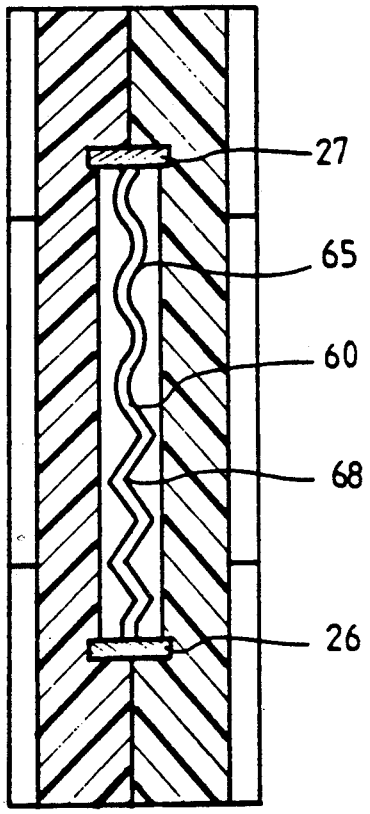
FIG. 7 is a side view in section of a device comparable to that of FIG. 1, but in which the slit for laminating the arc has a sinuous path.

In a modified embodiment, shown in FIG. 7, which proposes increasing the voltage of the arc by increasing its length, slit 60 is not rectilinear as in the above described embodiment, but it follows a sinuous path 65 or sawtooth path 68.

The switch device 1, housed in an insulating case 2, forms, after mounting, a self-contained whole which can be installed removable or not in any apparatus 49, see FIG. 1. Because of the small thickness —d—, see FIG. 2, which may be obtained when fins for splitting and cooling the arc are not used, the switch module which has just been described is particularly well adapted to incorporation in modular cases fixed for example on a standardized rail. Its small thickness also makes possible the space-saving mounting of several parallel modules in appropriate housings of multi-phase apparatus such as circuit breakers or contactors with protection.

The switch device 1 which has just been described comprises, for limiting the short circuit currents efficiently as possible, a double cut-off contact bridge having the advantage of adding together the voltages of the two arcs appearing between the pairs of contacts 3, 13; 4, 14. Such an arrangement, which makes it possible to obtain a given arc voltage more readily with a reduced stroke of the mobile pieces is however not the only one likely to benefit from the advantages obtained by choking the arc in a long and narrow slit.

With an obvious adaptation of the form of the cut-off chamber, it is also possible not only to use a single cut-off switch comprising a mobile contact lever but further to use two conducting levers in which each of the two ends is equipped with a mobile contact stud placed respectively in each of two particular chambers, each having a choke slit such as mentioned above. Such arrangements may naturally benefit, as above, from means for assisting development of the arc whose actions will be efficient as far as the zones of the chambers where the choke slits are disposed. Flat magnetizable pieces 71, 72, which could be associated with current loops for increasing the efficiency of their magnetic effects, would be disposed externally of the case in the planes WW' or QQ', see FIG. 2.

Figure 8:
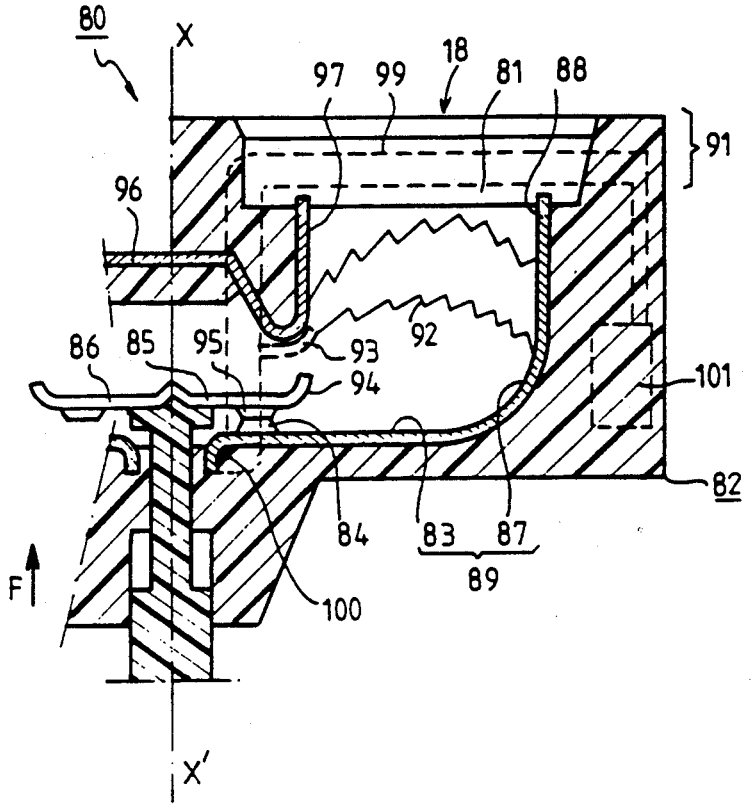
FIG. 8 is a schematic sectional view through a mean plane of a switch apparatus in which the arc laminating slit has been disposed differently.
Figure 9:
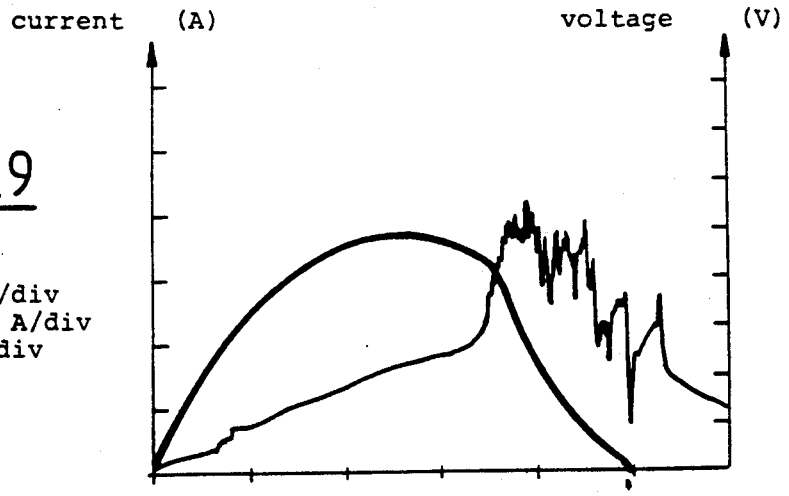
FIG. 9 illustrates a system of curves showing the evolution of the arc voltage and that of the current during opening on a short-circuit.

In a modified embodiment 80, shown in FIG. 8, a particular shape of the arc deflecting pieces makes it possible to place slit 81 in a region of case 82 distinct from those shown above.

Whereas, in the above instances, the deflector has a rectilinear portion 83 which extends from the fixed contact stud 84 in a direction substantially parallel to that of the cross piece 85 of the mobile contact bridge 86, a curved extension 87 leads the end 88 of the deflector assembly 89 as far as the entrance of a slit 81 which is here formed in an upper region 91 of case 82.

This upper region may be defined as that towards which the contact bridge 86 is directed when there occurs opening in direction F of the switch by movement of the latter along the axis of symmetry XX'.

Considering the new orientations which an arc 92 will assume during natural or assisted swelling thereof by moving its feet along the deflector 89 and over the horn 93 carried by each neighboring end 94 of the mobile contact stud 95, the common upper deflector 96 will adopt a curved shape 97 substantially parallel to extension 87, 88 so as to extend as far as slit 81.

When such an arrangement is chosen, for example so that the escape of gases developed in direction F at the time of cut-off is directed towards a rear zone 18 where expansion thereof does not risk affecting adjacent apparatus, appropriate baffles may be advantageously disposed between the apparatus and a metal support frame for preventing possible re-closure of the arc thereon.

As in the preceding embodiments, one or two current loops 99 may be advantageously associated externally with the case for promoting swelling of the arc. They will be attached to a conducting region 100 close to the fixed contact stud and to a connection terminal 101.

Derivative devices, shown generally in the form of double cut-off contact bridge switch devices, may be readily developed by a man skilled in the art for applying them to single cut-off switches where, for example, a contact lever is connected to one of the two terminals by a deformable conductor such as a copper braid.

It will be finally noted that although the use of the current loops shown is justified when the rated currents of the apparatus are relatively small (for example up to 60A), their use may not be indispensable for higher current ratings. If required, magnetizable structures outside the case, such as U shaped pieces, may be combined with the extinction loops or with any other arc development assistance means.

What is claimed is:

1. A current limiting switch device comprising in an insulating case:

at least one cut-off chamber housing a fixed piece and a switching piece movable in a predetermined direction in a plane, said pieces being equipped with contact studs and a movable control member acting on the switching piece for making and breaking an electric circuit;

a conducting deflector which is connected electrically to the fixed piece and which extends into the chamber so that one of the feet of the arc appearing on opening of the electric circuit may move in said chamber;

the chamber having two opposite walls converging towards an elongate narrow slit which communicates with the outside of the insulating case and which is placed substantially in said plane so that a considerable portion of the length of the arc is driven therein during development thereof, wherein:

the deflector has an end situated in the vicinity of one end of the slit or in the slit, the width of the chamber and the dimensions of the slit cause narrowing of the section of the arc, at least one conductor forming a loop placed outside the chamber is connected to the fixed piece and passes in front of the slit.

2. The switch device as claimed in claim 1, wherein said slit extends parallel to said predetermined direction in a region of the insulating case where said loop ceases to exert its influence.

3. The switch device as claimed in claim 1, wherein said electric circuit has two terminals, said loop extends in a further plane substantially parallel to said plane and is connected to one of said terminals.

4. The switch device as claimed in claim 1, wherein a magnetizable structure is placed outside the chamber, in close proximity to said conductor.

5. The switch device as claimed in claim 1, wherein a further cut-off chamber, identical to said cut-off chamber and housing, a further fixed piece, a further switching piece integrally built with said further fixed piece for forming a contactor bridge having an axis of movement in said predetermined direction, said further pieces being equipped with further contact studs, a further deflector connected electrically to the further fixed piece, is disposed symmetrically with respect to the said axis of movement, a further conductor forming a further loop being placed outside the further cut-off chamber and integrally built with said further loop.

6. The switch device as claimed in claim 1, wherein a second conducting deflector extends in said chamber between further opposite slit ends.

* * * * *